United States Patent [19]

Stensson et al.

[11] 4,287,968

[45] Sep. 8, 1981

[54] DEVICE AT A BRAKE ACTUATOR

[75] Inventors: Bo G. Stensson, Teckomatorp; Jan O. Harström, Malmö; Jan Csiba, Påarp, all of Sweden

[73] Assignee: SAB Industri AB, Landskrona, Sweden

[21] Appl. No.: 85,285

[22] Filed: Oct. 16, 1979

[30] Foreign Application Priority Data

Nov. 2, 1978 [SE] Sweden ..... 7811340

[51] Int. Cl.[3] ..... F16D 49/00

[52] U.S. Cl. ..... 188/74; 92/129; 92/187; 188/153 R; 188/217; 403/56; 403/113; 403/124

[58] Field of Search ..... 188/74, 361, 363, 364, 188/365, 71.1, 72.2, 153 R, 153 A, 153 D, 217; 403/76, 113, 122, 124, 125, 56, 53; 92/129, 187

[56] References Cited

U.S. PATENT DOCUMENTS

| | | | |
|---|---|---|---|
| 417,194 | 12/1889 | Lawrence | 188/153 R |
| 2,937,721 | 5/1960 | Parrett | 188/72.2 X |
| 3,177,020 | 4/1965 | Dumpis | 403/122 X |
| 3,185,258 | 5/1965 | Douglas | 188/72.2 |
| 3,321,049 | 5/1967 | Swift | 188/72.2 X |
| 3,422,934 | 1/1969 | Hambling | 188/72.2 |
| 3,651,897 | 3/1972 | Hahn | 188/72.2 |
| 3,809,190 | 5/1974 | Evans | 188/72.2 |

FOREIGN PATENT DOCUMENTS

| | | | |
|---|---|---|---|
| 390083 | 2/1924 | Fed. Rep. of Germany . | |
| 390803 | 2/1924 | Fed. Rep. of Germany . | |
| 1131531 | 6/1962 | Fed. Rep. of Germany | 188/72.2 |
| 1050623 | 12/1966 | United Kingdom | 188/72.2 |

*Primary Examiner*—George E. Halvosa
*Attorney, Agent, or Firm*—Laurence R. Brown

[57] ABSTRACT

A device at a brake actuator for permitting thrust force transmission between an axially movable push rod (4) of the actuator and a brake block holder (6) moving out of line with the push rod.

In order to ensure force transmission irrespective of the brake block holder movements and to avoid any slippage between the members a transmission part (5) is arranged between the push rod (4) and the brake block holder (6) and has spherical surfaces in engagement therewith, these surfaces having a common center.

1 Claim, 3 Drawing Figures

DEVICE AT A BRAKE ACTUATOR

TECHNICAL FIELD

This invention relates to a device at a brake actuator for thrust force transmission between an axially movable push rod of the actuator and a brake block holder moving out of line with the push rod.

BACKGROUND OF THE INVENTION

A brake block holder often moves out of line with the brake actuator push rod acting thereon for brake application. Due to its normal suspension it will move along a circular line in the plane of the push rod axis, but sometimes it must also be laterally movable, which makes it necessary to find another solution than the simple type of transmission with a wedge engaging a groove as shown in GB No. 1,140,488.

For different reasons, for example the rough environment, it is also preferred to avoid any slippage between the different parts.

DISCLOSURE OF INVENTION

These requirements, together with the basic requirement of a faultless force transmission, and the need for a simple but reliable solution are according to the invention fulfilled in that a transmission part is arranged between the push rod and the brake block holder and has spherical surfaces in engagement therewith, these surfaces having a common center.

A preferred embodiment has the further feature that the end of the push rod has the form of a sleeve with a cup-shaped bottom and with axial slots for cooperating with pins on the transmission part, a rubber bushing being provided between said sleeve and the transmission part. In this way the push rod and the transmission part will be held together in a non-rotatable way, and the latter will be biased towards a neutral position in line with the push rod.

The brake block holder may be provided with a plane for cooperation with the transmission part and lateral flanges at either side of said plane, the flanges having the purpose to guide the transmission part laterally and prevent rotation thereof.

BRIEF DESCRIPTION OF THE DRAWING

The invention will be described in further detail below reference being made to the accompanying drawing, in which.

DESCRIPTION OF THE PREFERRED EMBODIMENT

Figure 1:
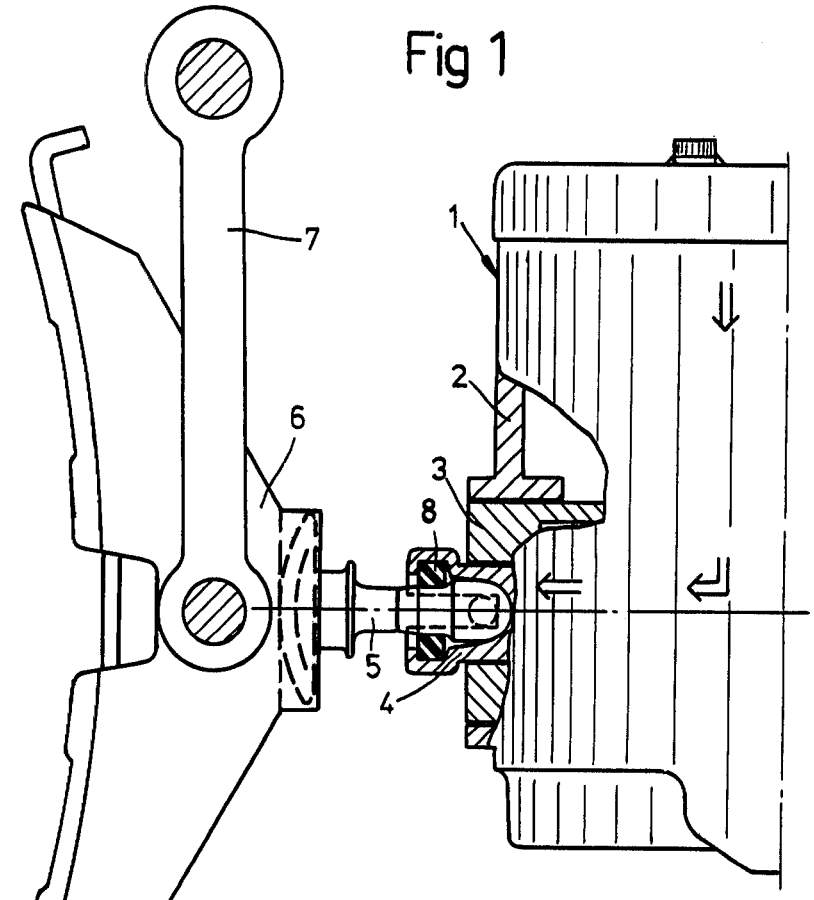
FIG. 1 is a side-view, partly in section, of an arrangement embodying the invention.
Figure 2:
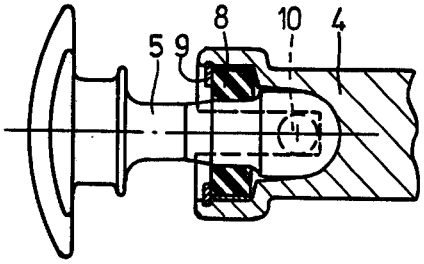
FIG. 2 is a section to a larger scale of the essential part of FIG. 1.

A conventional brake unit 1 is to be attached to a vehicle underframe (not shown) in an ordinary way. Only a limited part of this brake unit 1 is shown, namely a wall 2, an adjuster tube 3 and a push rod 4, which preferably is a threaded spindle of the slack adjuster built-into the brake unit. In the present case there are means (not shown), as indicated by arrows in FIG. 1, to transform a movement downwards of a piston (not shown) at the admission of fluid under pressure into a movement to the left in the drawing of the push rod 4.

By means of a transmission part 5 this movement will be transmitted to a brake block holder 6, which is suspended from the vehicle underframe (not shown) by means of brake block hangers 7.

At its end in contact with the push rod 4 the transmission part 5 is spherical for coacting with a corresponding cup-shaped surface in the push rod, and at its other end the part 5 is likewise spherical for coacting with a flat surface on the brake block holder 6. These two spherical surfaces on the transmission part 5 have a common center, which in the shown case is rather close to the right hand end of the transmission part 5 but which could be placed elsewhere in said part depending on the circumstances. The feature with the common center for the two spherical surfaces means that no slippage will occur between the transmission part 5 and the members coacting therewith, irrespective of the position of the brake block holder 6 relative to the push rod 4 or in other words irrespective of the angular departure of the transmission part 5 from its neutral position, this departure however in a practical case being limited to say 3° to 4°.

Forces perpendicular to the push rod 4 due to perpendicular block holder movements will be reduced at the push rod end by the ratio between the radii of the large and small spherical end surfaces compared to the case with the push rod 4 acting on the block holder 6 directly.

Figure 3:
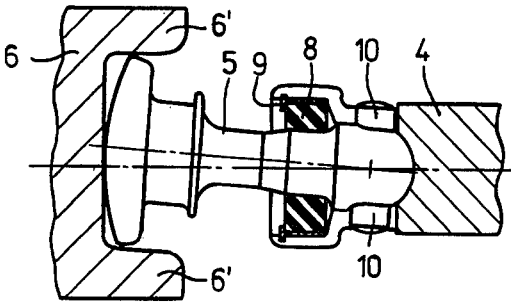
FIG. 3 is a section corresponding to FIG. 2 but perpendicular thereto.

Due to a comparatively loose suspension of the brake block holder 6 movements thereof will occur relative to the axial direction of the push rod 4. Due to the suspension the brake block holder 6 will always move along a circular line (in the plane of the push rod axis) during a brake application, but also in the lateral direction movements will be allowed, as illustrated in FIG. 3. Due to the fact that the brake block holder 6 is provided with flanges 6' the transmission part 5 will be forced to follow such lateral brake block holder movements, also with the brake in released position.

A rubber bushing 8 between the sleeve-shaped end of the push rod 4 and the transmission part 5 acts as a means for keeping these members together and will provide a force on the transmission part 5 biasing the same to its neutral position. The bushing 8 is held in proper position by a spring clip 9.

For the proper functioning of the slack adjuster built into the brake unit 1 and also for other reasons it may be essential to prevent rotational movements of the push rod 4, which as said is the spindle of the slack adjuster. This is in the shown case attained in that pins 10 extending outwardly from the transmission part 5 cooperates with axial slots in the push rod and also in that the transmission part 5 is held against rotation by means of its coaction with the brake block holder flanges 6'.

Although the term brake unit has been used this is not meant to exclude any brake actuator or the like.

Different modifications are possible within the scope of the appended claims. It is for example possible to have other arrangements than the bushing 8 and the pins 10 for returning the transmission part 5 to its neutral position and to prevent it from rotating.

We claim:

1. A braking system with a brake shoe movable along an arcuate path and thereby operable in the presence of substantial lateral movement of a brake block holder comprising in combination, said brake block holder in said arcuate path adapted to move a brake shoe into contact with a rotating surface along a movement line and thereby having a degree of motion lateral to a linear movement line, a push rod having a linear movement path, means actuating the push rod in a substantially linear back and forth direction along said linear movement line for actuating the brakes by moving said brake shoe in and out of said contact, a transmission part substantially disposed along said linear movement line between said brake block holder and push rod to move substantially along the linear movement line comprising a transmission rod having a longitudinal axis diposed in a neutral position along said linear movement line with spherical surfaces of differing diameters disposed on opposite ends thereof to engage respectively the brake block holder at a substantially flat surface and the push rod in a cup shaped surface to coact therewith to permit an angular departure of the order of 3° to 4° from said neutral position relative to the push rod, the radius of the spherical surface in contact with the brake block holder being substantially larger than that of the spherical surface in contact with the push rod thereby to reduce the forces exerted on the push rod perpendicular to said linear movement path when the brake shoe moves along said arcuate path, wherein the respective spherical surfaces are in substantially unconfined movable surface contact with the flat and cup shaped surfaces and have a common center thereby eliminating slippage between the spherical surfaces with the respective block holder and push rod surfaces, and rotation prevention means comprising members engaging the push rod, the brake block holder and the transmission part thereby holding the transmission rod non-rotational about its axis whereby the brake block holder upon actuation of the push rod moves the brake shoes into contact with the rotating surface in the presence of said lateral motion without imparting a rotational movement to the push rod.

* * * * *